US006113009A

United States Patent [19]

Chih

[11] Patent Number: 6,113,009

[45] Date of Patent: Sep. 5, 2000

[54] SPRINKLER HEAD ADJUSTING STRUCTURE

[76] Inventor: I-Shun Chih, No. 5. Tyan Yang Lane, Lu Kang Chen, Chang Hua County, Taiwan

[21] Appl. No.: 09/110,412

[22] Filed: Jul. 6, 1998

[30] Foreign Application Priority Data

Jul. 4, 1997 [TW] Taiwan ..... 86211274

[51] Int. Cl.[7] ..... A62C 31/02

[52] U.S. Cl. ..... 239/394; 239/391

[58] Field of Search ..... 239/436, 435, 239/440, 441, 525, 526, 527, 391, 394

[56] References Cited

U.S. PATENT DOCUMENTS

| | | | |
|---|---|---|---|
| 151,823 | 6/1874 | Baldwin | 239/394 |
| 4,618,100 | 10/1986 | White et al. | 239/440 |
| 4,901,927 | 2/1990 | Valdivia | 239/446 |
| 4,909,443 | 3/1990 | Takagi | 239/440 |
| 5,100,055 | 3/1992 | Rokitenetz et al. | 239/11 |
| 5,232,162 | 8/1993 | Chih | 239/394 |
| 5,598,978 | 2/1997 | Wang | 239/394 |
| 5,630,548 | 5/1997 | Chih | 239/394 |

*Primary Examiner*—Andres Kashnikow
*Assistant Examiner*—Jorge Bocanegra
*Attorney, Agent, or Firm*—Dougherty & Troxell

[57] ABSTRACT

An improved sprinkler adjusting head structure having a spray head with a net like water spray outlet, whole water outlet, and other water pattern outlets. These outlets extended inside the spray head to a connector body with the same number of outlets as those of the spray head. When the spray head is connected with the connector body it has specific position for each outlet. The water outlet of a main body deviates from the center line of the main body and bears against the water inlet in the bottom of the connector. Some of the water pattern outlets in the connector extend toward the spray head are combined with the circulating outlet of the spray head. Also the outlets in the connector are separated into two water outlet chambers by dividers. A concave trough is created in the middle of the several outlets. A water channel connector coordinates the circulating water patterns as well as the connection to the net like water spray, and a whole water outlet. Thus, it is possible to operate the spray head with many water spray patterns simultaneously.

1 Claim, 12 Drawing Sheets

FIG. 18
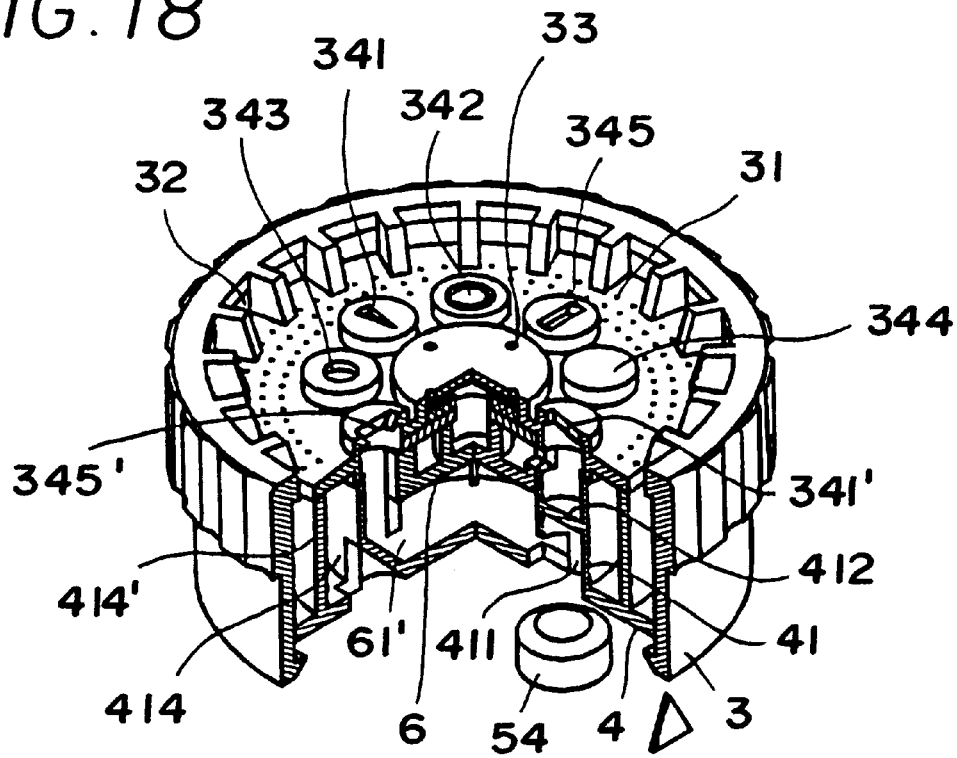
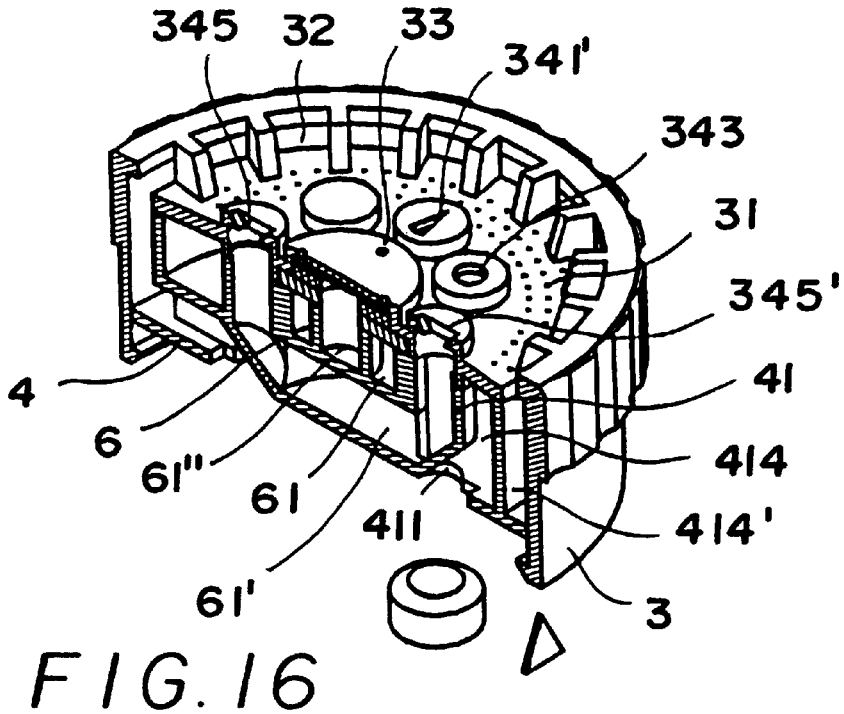
FIG. 16

SPRINKLER HEAD ADJUSTING STRUCTURE

BACKGROUND OF THE INVENTION

1. Field of the Invention

The objective of this invention is to improve the conventional water sprinkler head that can only perform a single water pattern at a time in spite of having many circulating water patterns available. Furthermore, due to the structural improvement of this invention, it is possible to make two or more available patterns perform simultaneously.

2. Description of the Related Art

There are many types of water sprinklers having different structures available in the market. The complexity of the structure is closely associated to the number of water patterns generated. A simple water sprinkler structure may generate many complex water patterns as shown in FIG. 1. Its structure consists of a handle 1 and a main body 11, with a connected water channel 12 inside the main body. There is a valve rod 13 inside the channel 12. The end of the valve rod 13 passes outside of the main body with a screw and a pressure board 14. The front end of the channel 12 is a narrowed valve point 15. Valve rod 13 can seal off valve point 15 so that water pressure in channel 12 cannot go through outlet 16. If the valve rod 13 is retreated from the position due to the pressure given by the pressure board 14, water pressure in channel 12 can go through the outlet 16. A sprinkler head 17 may rotate with several nozzles. In general, sprinkler head 17 has four nozzles 171 which are different from each other, such as opened fan, water pillars, flat fan, or spreading all directions. Sprinkler head 17 uses a screw 18 to pierce through the combination hole to connect to the center post 181 of the main body 11. Also, there is a special structure 19 and a positioning groove 172 inside of the sprinkler head wall to align a nozzle 171 of the sprinkler head 17 with the water outlet 16. Although the structure of these conventional sprinklers is very simple, they can generate complex water spray patterns but still have drawbacks that can be improved.

First of all, the sprinkler head 17 requires a screw 18 to pierce through an assembling hole to connect with the center post 181 of the main body 11 so that sprinkler head 17 can connect with the main body 11. On one hand if the screw 18 is screwed too tight, the sprinkler head 17 is difficult to rotate so that the nozzle 171 can't make a smooth connection to the water outlet 16. On the other hand, if the screw 18 is not screwed in tightly, the nozzle 171 on the sprinkler head 17 cannot contact tightly with the water outlet 16 so that all of the water pressure cannot get into the nozzle 171 and some will spill out.

Next, as we see the sprinkler head 17 uses a screw to connect with the main body 11. However, to keep tight the contact of the nozzle 171 to the water outlet 16 for a long time is a tough task for the sprinkler head 17 to do, and in due time the sprinkler head 17 will not tightly hold contact with the water outlet 16. Consequently the sprinkler will be scrapped.

Moreover, in this type of sprinkler the pressure control board 14 retracts the valve rod 13 and lets water pressure go through valve 15. At this moment if we rotate the sprinkler head 17 and make a nozzle 171 connect to the water outlet 16 to perform a spray water pattern, the water of the outlet 16 will leak out or spill out from the outlet. This is a well known defect of the conventional sprinkler head.

Furthermore, the water spray efficiency of this sprinkler type is limited by its structure. Unless the nozzle 171 is precisely connected to the water outlet 16 some water will leak out.

Now, please refer to FIGS. 2A and 2B. These are the improvements made by the Applicant to the drawbacks described above.

Sprinkler Head 26: Upper rotating nozzle 261 of the sprinkler head has a considerable length of wall extending inward, and on the inner wall surface inside of the mouth edge are several convex hook points 262 equally spaced on nozzle 261, and also a positioning groove.

Connector 27: There is a water channel 271, inside the connector the Channel 271 narrows to form a valve point 272. A water outlet 273 deviates from the center line and extends through the divider panel 274. The diameter of the divider panel 274 is a little larger than the assembly seat 211 of the main body 21, and the same size as the inside diameter of the sprinkler head 26. The divider panel 274 has a washer groove 275 for washer 276 to prevent leaking.

Main Body 21: The front end has the assembly seat 211 of the Main Body 21, an elliptic ring chuck 212 and a positioning hole 213 under the assembly seat 211.

When the chuck ring 212 of the main body 21 and sprinkler head 21 through the hook points 262 are connected, it can perform various combinations of water patterns. Furthermore, it is possible to install another connector 27 between them so that sprinkler head 26 can utilize water pressure from the outlet of the added connector 27 to generate strong or weak water pressures from the nozzle 261 and/or to perform the water net pattern previously prepared at the nozzle 261.

No matter if the sprinkler is the conventional one or the one improved by the Applicant, because only one nozzle can be connected with valve outlet. Therefore, only a single water pattern can be performed and, consequently the water spray area is limited. This is another weak point to be reinforced or improved.

SUMMARY OF THE INVENTION

The main objective of this invention is to provide an improved adjusting structure for a water sprinkler head, one that has a water outlet and a rotating nozzle head having several water pattern nozzles. The nozzles extend a considerable length with extension wall panels to make a connector and extend to the sprinkler outlet to make a tight connection. Once the whole sprinkler head is united with the connector nozzles, there is a fixed position for each nozzle and a spring coordinating with the connector to make the rotation to select the position. However, the water outlet deviates from the center line and matches the water inlet located in the bottom of the connector. The main feature of this invention is that the extended rotation nozzle pipes may design the water pattern associated with the sprinkler.

The nozzle pipes are separated by divider panels to form two water chambers. In the space among those extending toward the sprinkler head rotating water outlets form a concave trough to connect with a connector piece so that the rotating water pattern nozzles outside can connect to this connector and create a relative rotating channel. Furthermore, through the above combinations, it offers those rotating various water pattern nozzles above the sprinkler head to break through the old constraint of any one outlet water spray condition and attain several same or different water patterns spraying simultaneously.

When the space surrounded by the extended water pipe is separated by a divider to create two water chambers with two water outlets, so that on one hand the main body water outlet that deviates from the center line corresponds to the water supply of the water inlet in the bottom can directly supply the connected nozzle to perform a single pattern spray or go through the connector to supply water to more nozzles. Thus, a new performance of simultaneous spray from two or more nozzles is attained. Likewise, the original input water pressure supply can be controlled to different spray patterns to cover a wider areas.

BRIEF DESCRIPTION OF THE DRAWINGS

Again the structure, special features, and operation of this creation are explained with the illustrations below for your inspection reference. Figures used in the illustration are listed below:

FIG. 4 is an exploded perspective view of the spray head assembly of the present invention.

FIG. 16 is a cross-sectional, perspective view of the spray head showing a fifth nozzle connected to the water supply.

FIG. 18 is a cross-sectional, perspective view of the sprinkler head showing a sixth nozzle connected to the water supply.

DETAILED DESCRIPTION OF THE PREFERRED EMBODIMENTS

Figure 1:
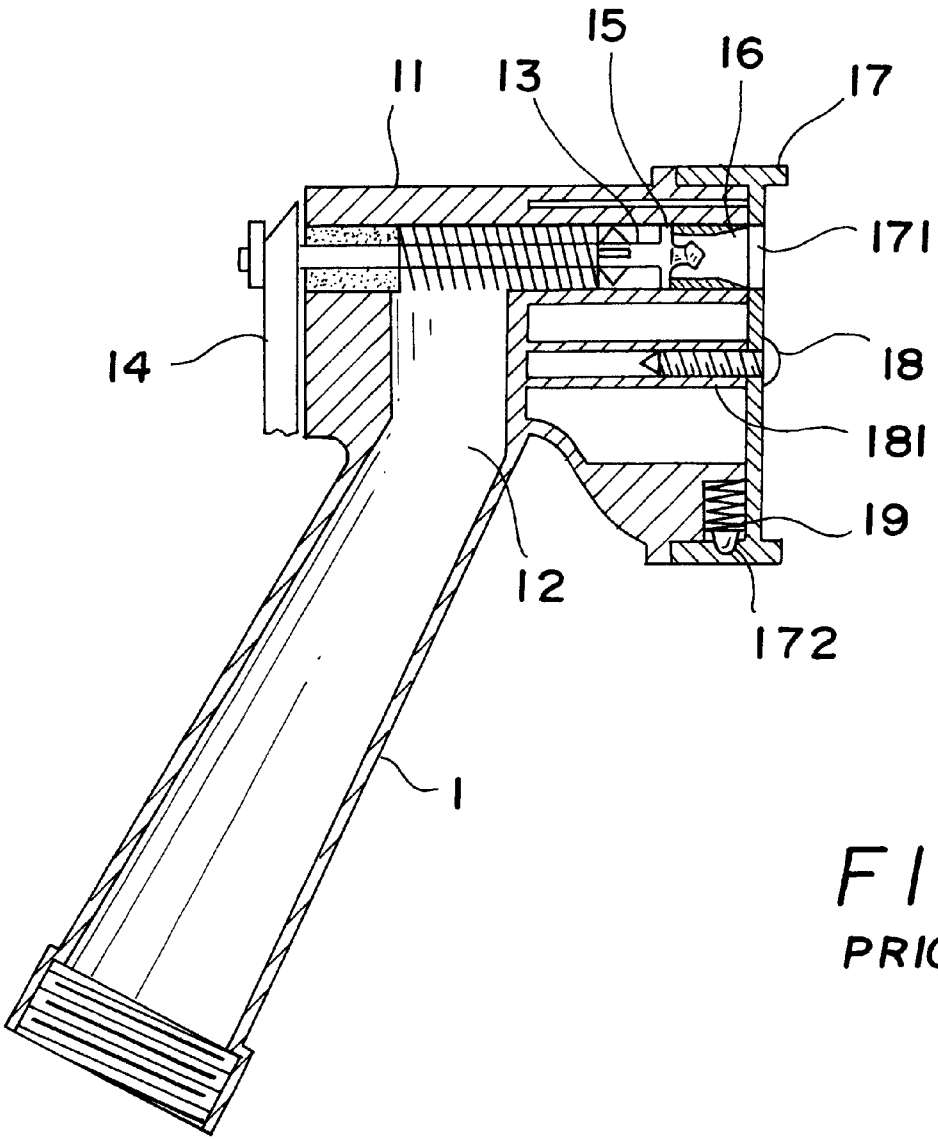
FIG. 1 PRIOR ART
FIG. 1 is a cross-sectional view of a known sprinkler head.
Figures 2A, 2B:
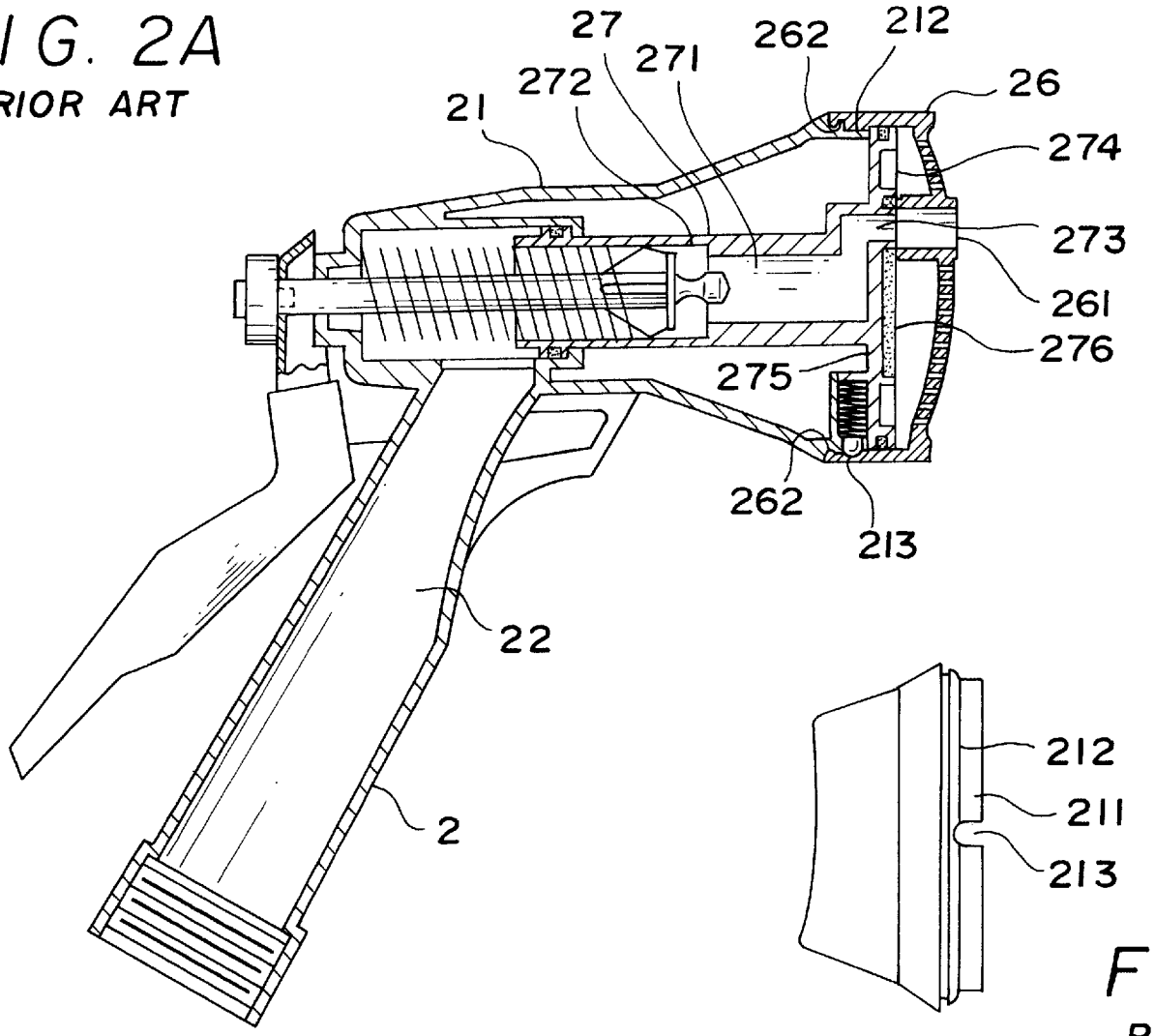
FIG. 2A PRIOR ART
FIG. 2B PRIOR ART
FIGS. 2A and 2B illustrate another known sprinkler head.
Figure 3:
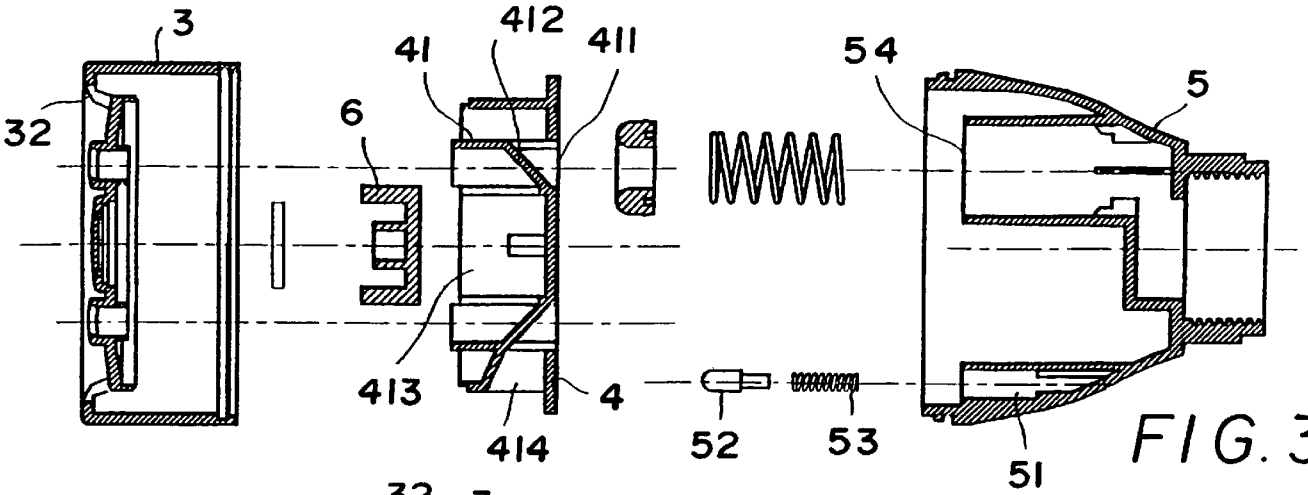
FIG. 3 is an exploded, cross-sectional view of the sprinkler head of the present invention.
Figure 6A:
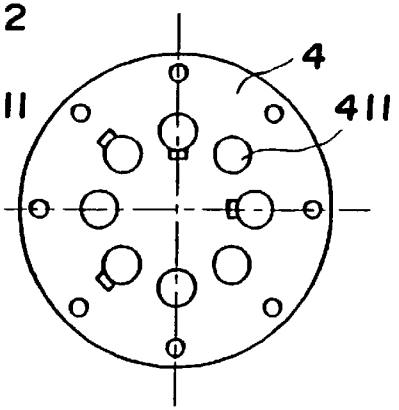
FIG. 6A is a rear view of the connector of FIG. 3.
Figure 6B:
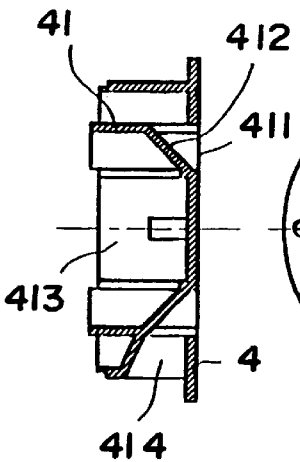
FIG. 6B is a cross-sectional view of the connector of FIG. 6A.
Figure 5B:
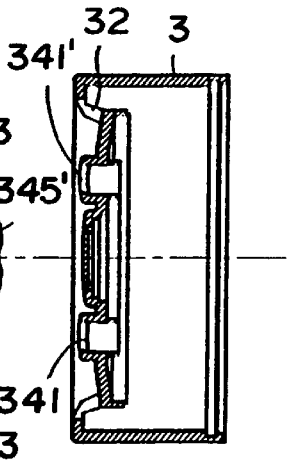
FIG. 5B is a cross-sectional view of the spray head of FIG. 5A.
Figure 5A:
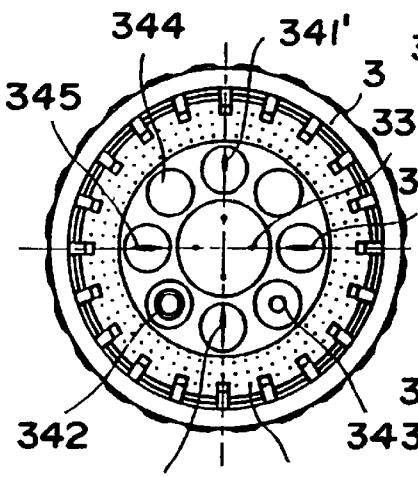
FIG. 5 is a front view of the spray head of FIG. 3.
Figures 4A, 4B:
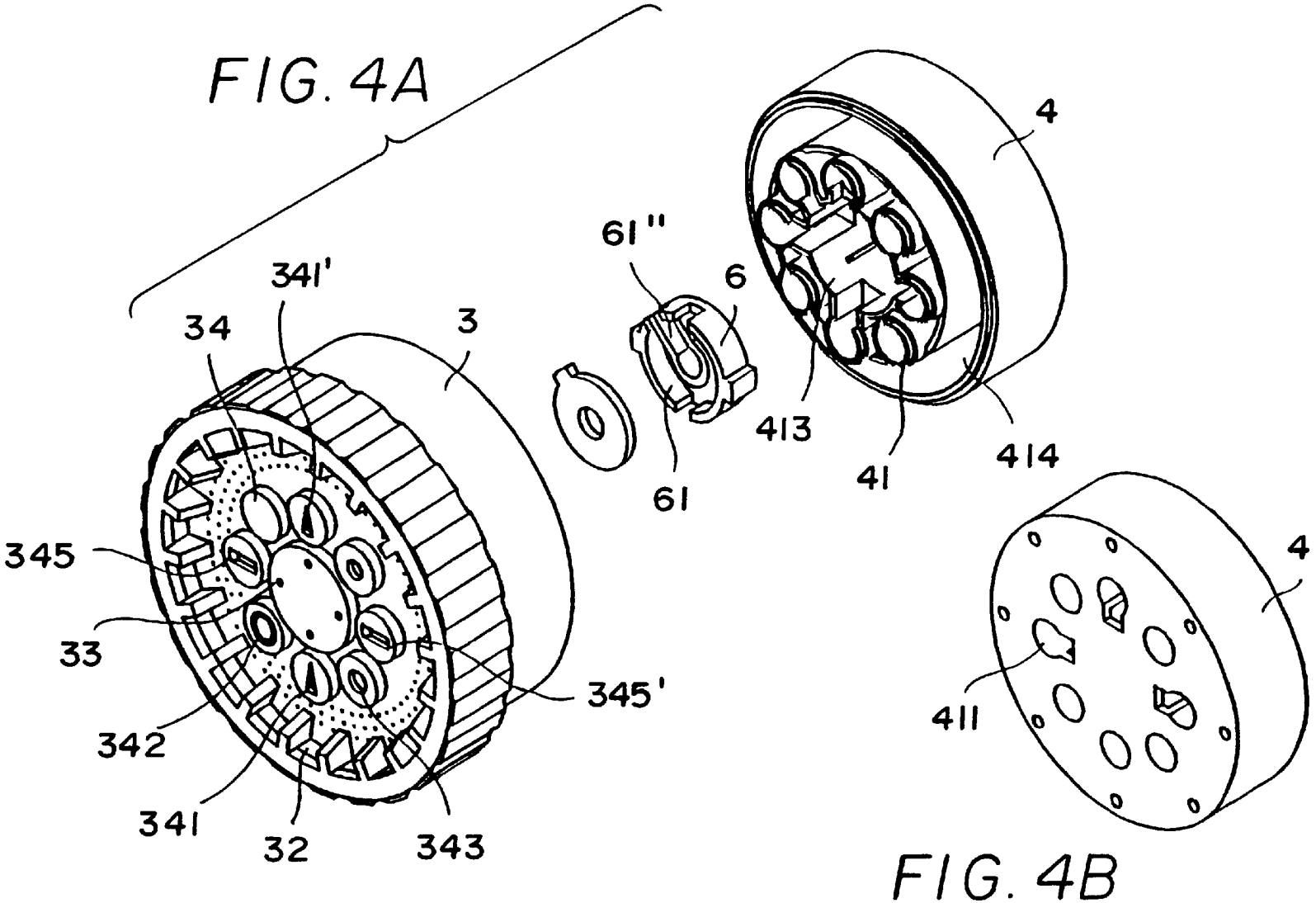
FIG. 4B is a rear perspective view of the connector of FIG. 4A.
Figure 7:
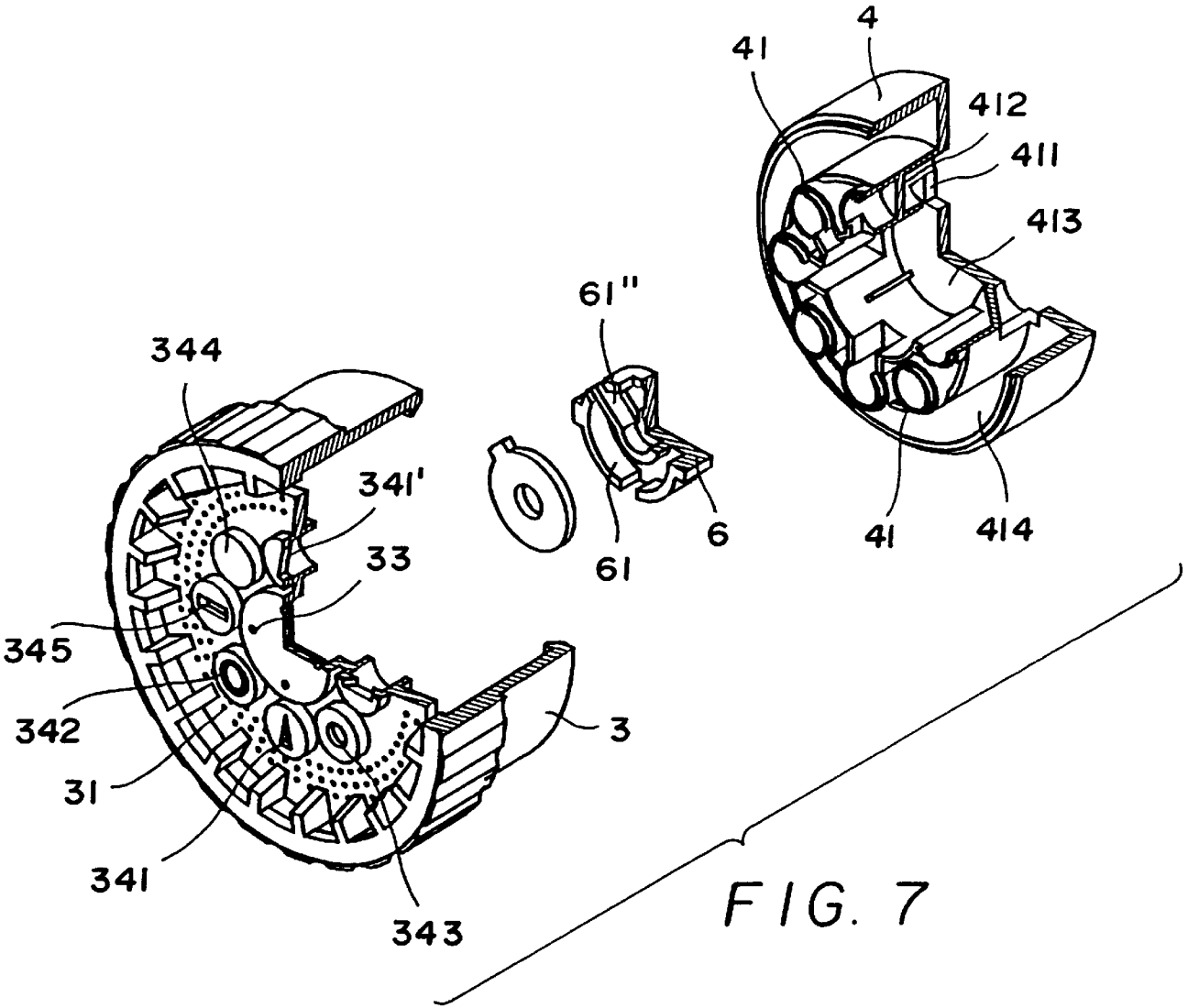
FIG. 7 is an exploded, cross-sectional perspective view of the sprinkler head illustrating a first portion of the connector.
Figure 8:
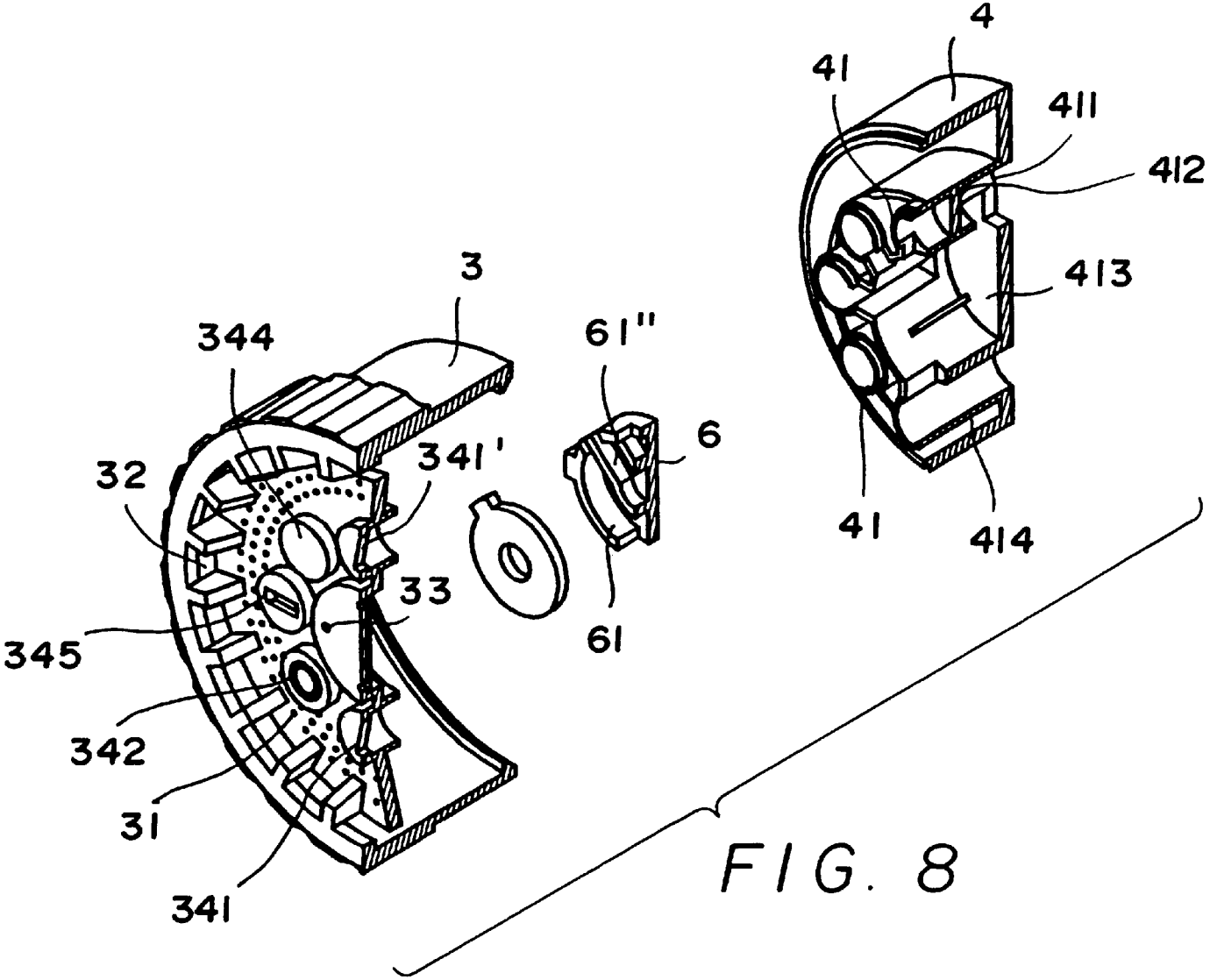
FIG. 8 is an exploded, cross-sectional perspective view similar to FIG. 7, but illustrating a second portion of the connector.
Figure 9:
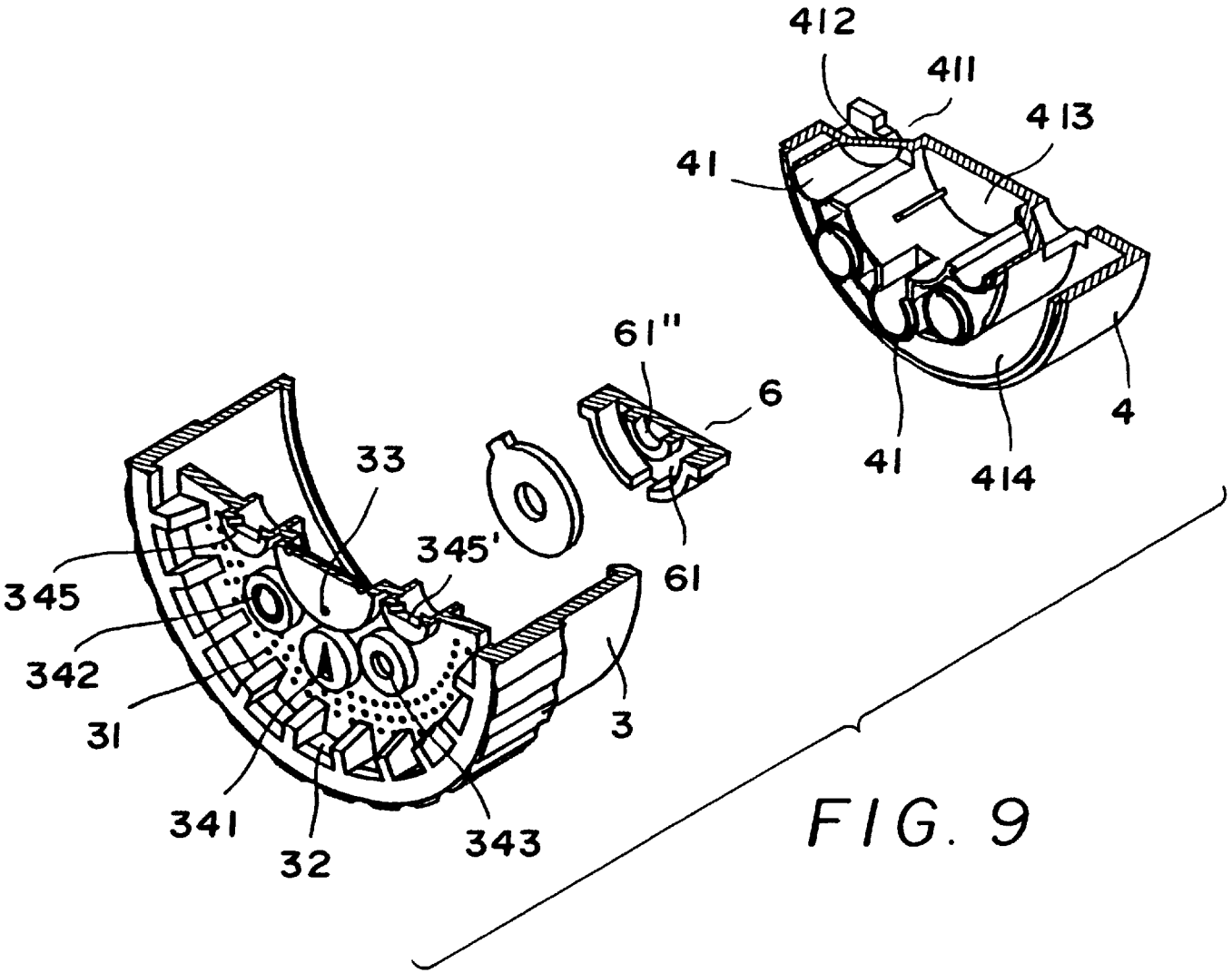
FIG. 9 is an exploded, cross-sectional perspective view similar to FIGS. 7 and 8, but illustrating a third portion of the connector.

Please refer to FIGS. 1–9. This sprinkler gun comprises a spray head 3 with a net of holes 31 to create a net like water pattern and a whole water outlet 32, mist holes 33 and rotating nozzles of different spray patterns (for instance, tilted fan shape 341, 341', diffusion nozzle 342, water pillar 1343, closed type 344, and flat fan shape 345, 345'). Those nozzles extend with a wall toward an inside to a proper length to a connector 4 which has extending pipes of the same number as the number of nozzles in the sprinkler head 3 and forms a water outlet tube case 41. Once the connector 4 is connected with the entire nozzles of sprinkler head 3, there is a positioning seat 51 with a positioning device 52, and a spring 53, engaging the connector 4 to select an appropriate rotating nozzle (since it is similar to those in conventional use we will not further explain it here). The outlet 54 deviates from the centerline of main body 5 and aligns with the water inlet 411 located in the bottom of water outlet tube case 41 on the connector 4. The most important feature of the invention is the connector 4 extended water outlet tube case 41 to include several patterns of rotating nozzles in it.

Corresponding to the water patterns the sprinkler head is to produce, a divider panel 412 is used to segregate the nozzles to make two water outlet chambers and also form a concave trough 413 in the center among those extended tube in the direction of the spray head 3. At the concave trough 413 is a connector 6 with appropriately arranged channels 61 and 61" which match the rotating water pattern nozzles of spray head 3 and also the net like pattern holes 31, and whole water outlet 32 to connect the channel 414.

Figure 10:
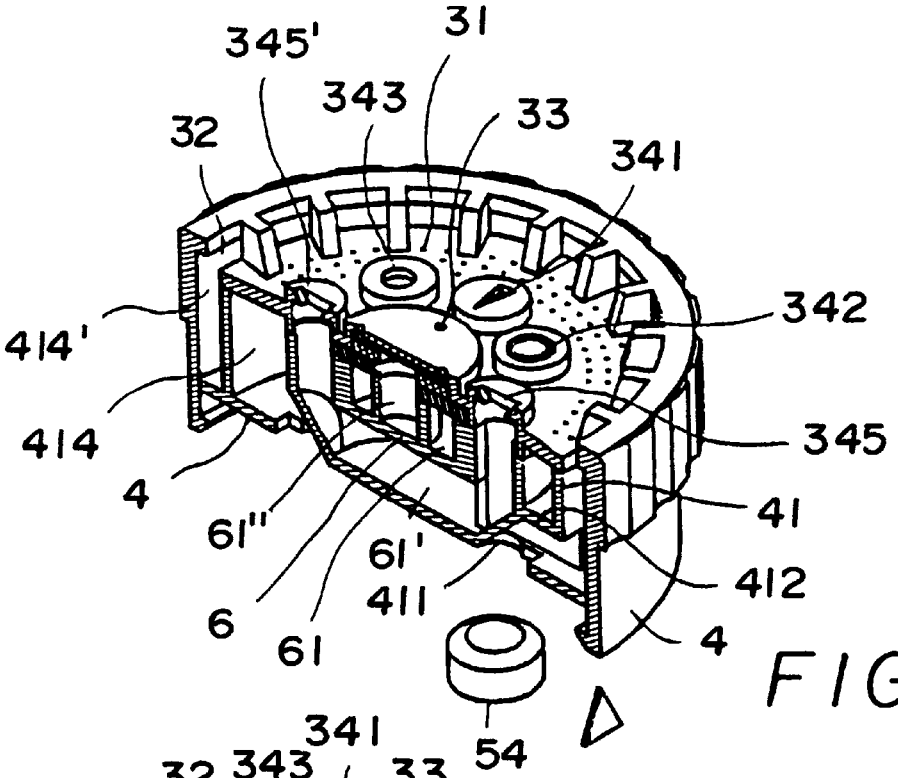
FIG. 10 is a cross-sectional, perspective view of the spray head showing a first nozzle connected to the water supply.
Figure 11:
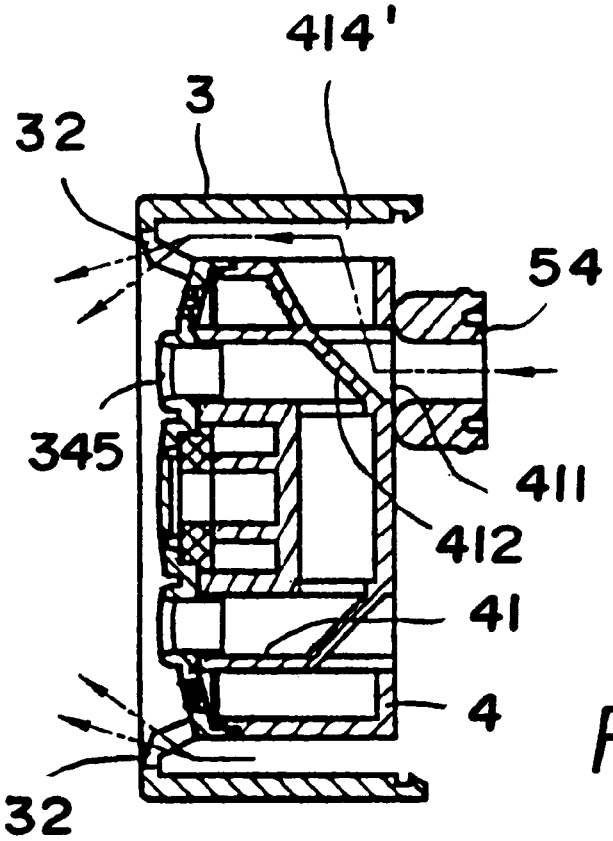
FIG. 11 is a cross-sectional view of the spray head of FIG. 10.

After understanding the structure described above we may proceed further to the remaining figures. All of them are illustrating practical application examples. The first example uses the rotary spray head 3 and the water outlet tube case 41 of the connector 4 that is separated into front and rear chambers by the divider panel 412. The front chamber is connected with the flat fan shape nozzle 345 while the rear chamber connects with the inlet 411 of the connector 4. The rear chamber also connects with several nozzles of rotating tube case 41 through the outside circulating channel 414 connected with whole water outlet 32 of the spray head 3. When the water inlet 411 of the rear chamber and the water outlet 44 at the end of the main body 5 are connected, the water flows through the outlet space of the rear chamber and passes through tube case 41 of the connector 4 and also the whole water outlet 32 of the spray head 3 to circulating channel 414, and finally sprays at the outlet 32 of the spray head 3 (See FIGS. 10 and 11).

Figure 12:
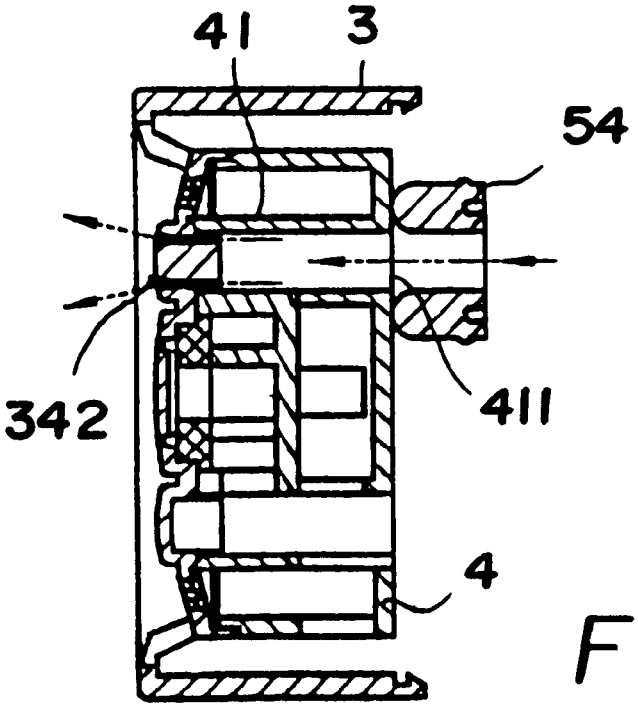
FIG. 12 is a cross-sectional view of the spray head with a second nozzle connected to the water supply.

When the rotary sprinkler head 3 lets the water outlet tube case 41 of the connector 4 directly connect to the diffusion nozzle 342, connected by the water inlet 411 of the outlet tube case 41 and the outlet 54 of the main body 5, the water flows in directly from the outlet space to diffusion nozzle 342 of the sprinkler head 3 to spray (See FIG. 12).

Figure 13:
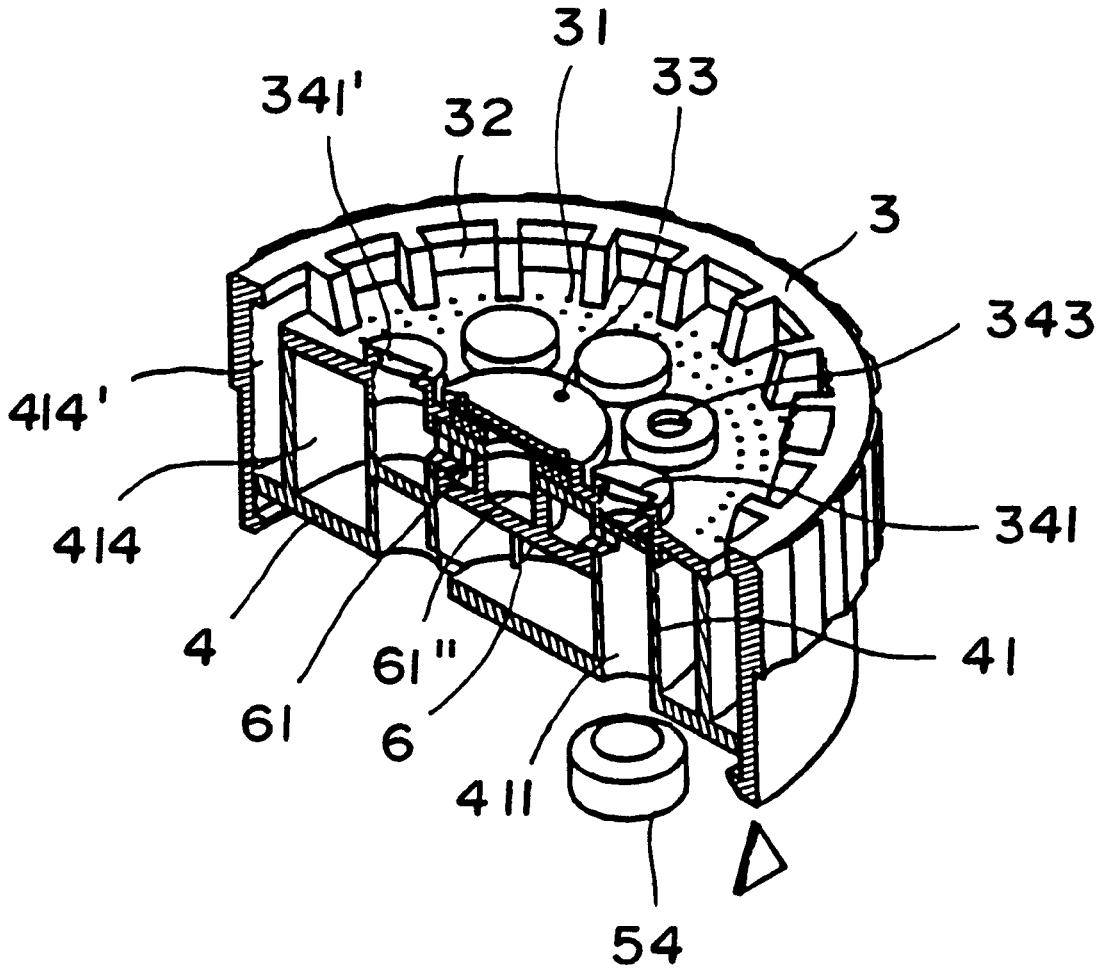
FIG. 13 is a perspective, cross-sectional view showing a third nozzle connected to the water supply.
Figure 17:
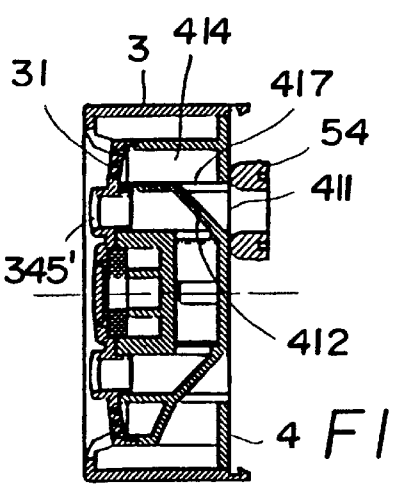
FIG. 17 is a cross-sectional view of the spray head of FIG. 16.
Figure 14:
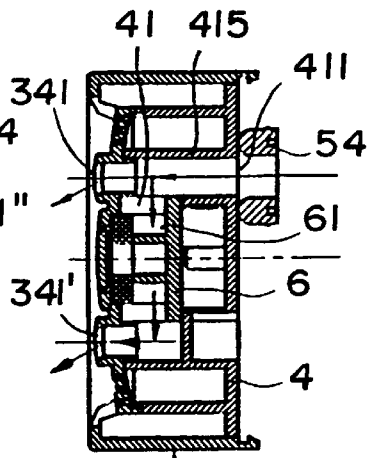
FIG. 14 is a cross-sectional view of the spray head of FIG. 13.

If the water outlet 41 of the connector 4 is directly connected with a single outlet space to tilt fan shape nozzle 341 of the spray head 3, and at the upper section of outlet space 41 is connected to the concave trough 413, then the water flows from the inlet space 411 to outlet 54 of the main body 5 and passes into the concave trough 413. It also enters the channel 61 of the center connector 6, and finally sprays out at tilt fan shape nozzle 341' with twin fan shape spray to increase the area covered. (See FIGS. 13 and 14).

Figure 15:
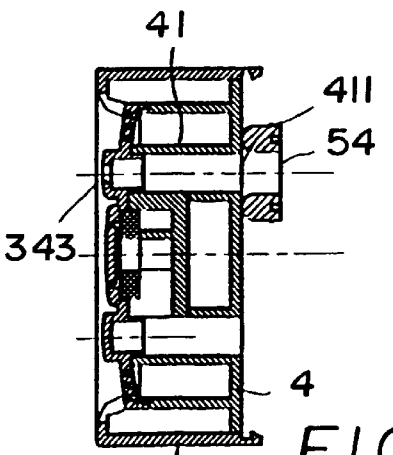
FIG. 15 is a cross-sectional view of the spray head with a fourth nozzle connected to the water supply.

If the water outlet 41 of the connector 4 is directly connected with a single outlet space to water pillar shape nozzle 343 of the sprinkler head 3, and the inlet 411 and the outlet 54 are connected, the water will come out of the water pillar nozzle effectively. (See FIG. 15)

Figure 19:
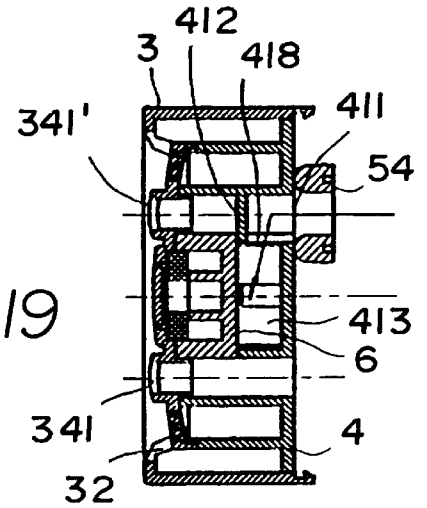
FIG. 19 is a cross-sectional view of the sprinkler head of FIG. 18.

When using rotary spray head 3, if the water outlet tube case 41, divided by dividing panel 412, is connected with the fan shape nozzle 345 outside circulating channel 414 is connected to the inlet 411 by opening 417. The water flows through the rear section of outlet water space, connector 4, and outlet tube case 41 inlet 411, net hole nozzle 31 and outside circulating channel 414, and finally spray through two flat fan shape nozzles 345 and 345' simultaneously and cover wider areas. (See FIGS. 18 and 19.)

Figure 20:
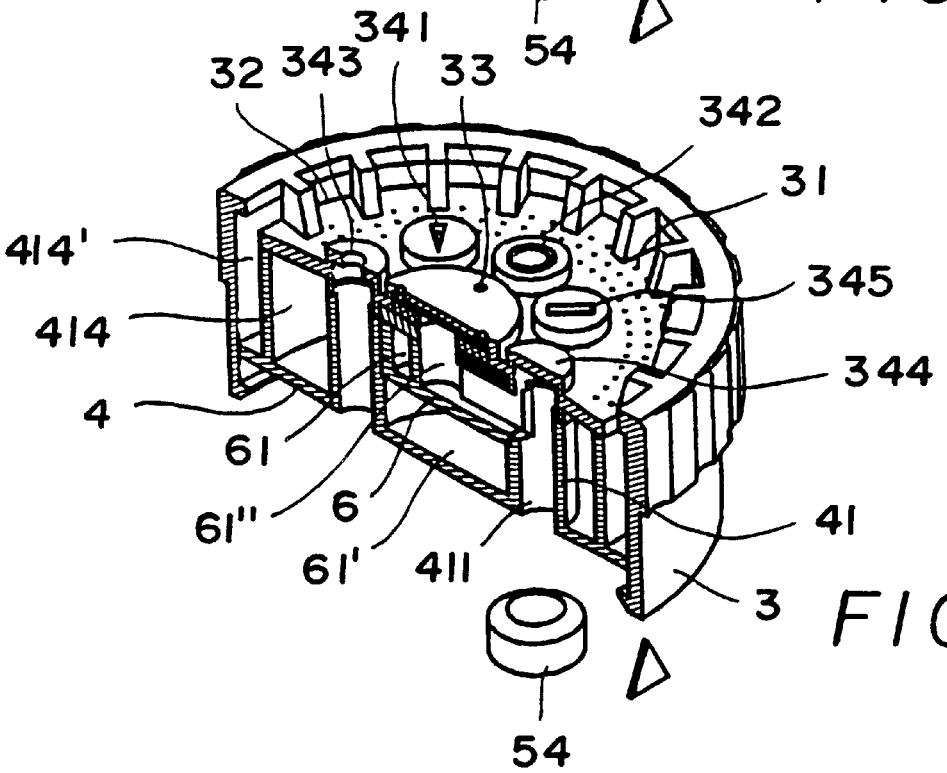
FIG. 20 is a cross-sectional, perspective view showing a seventh nozzle connected to the water supply.
Figure 21:
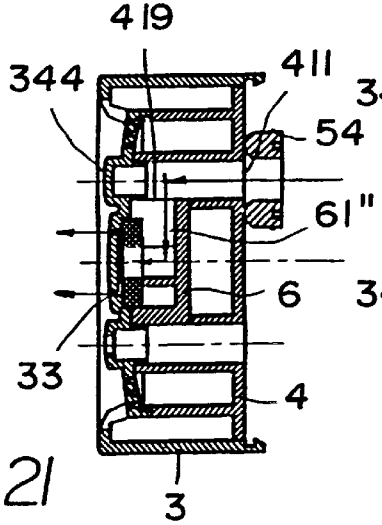
FIG. 21 is a cross-sectional view of the sprinkler head of FIG. 20.

When the rotary sprinkler head 3 is positioned to connect the water outlet tube case 41 of the connector 4 directly to closed nozzle 344, an opening 419 on the top of the outlet water space will connect the connector 4 to the central trough 413. When the water inlet 411 of the outlet water chamber and the water outlet 54 at the end of the main body 5 are connected, the water will come through the opening 418 on the top of the outlet water chamber, then through the central trough 413, the channel 67" and, finally, come out of the mist type nozzle 33 effectively. (See FIGS. 20 and 21.)

The above demonstrates that under the new structure of this invention, many combinations of water patterns are feasible. Furthermore, because of this invention, it is possible to break through the barrier of spraying only one pattern at a time so that it is now possible to have two or more nozzles of different water patterns spraying simultaneously.

What is claimed is:

1. A sprinkler head assembly comprising:

a) a main body with a central axis and having a water outlet displaced from the central axis;

b) a spray head rotatably connected to the main body, the spray head having a plurality of spray outlets including: a plurality of nozzles with different spray patterns, the plurality of nozzles arranged in a circular array; a plurality of mist holes located inside the circular array of nozzles; a plurality of net spray holes located in a circular array outside of the circular array of nozzles; and a plurality of whole water outlets located outside of the circular array of nozzles;

c) a connector mounted on the spray head so as to rotate therewith, the connection having a plurality of water outlet tubes arranged in a circular array, each water outlet tube communicating with one of the plurality of nozzles, the connector having a concave trough centrally located within the circular array of water outlet tubes, at least one outer circulating channel in fluid communication with the plurality of whole water outlets and with at least one water outlet tube, and a plurality of water inlets; and, d) a center connector located in the concave trough of the connector having a at least one channel in fluid communication with at least one of the plurality of water outlet tubes and the plurality of mist holes, whereby rotation of the spray head relative to the main body aligns one of the plurality of water outlet tubes with the water outlet such that in at least one position of the spray head and connector, water will be directed through at least two different spray outlets simultaneously.

* * * * *